US006095919A

United States Patent [19]

Fabel

[11] Patent Number: 6,095,919

[45] Date of Patent: Aug. 1, 2000

[54] EXTENDIBLE FORM FOR NON-IMPACT PRINTER

[76] Inventor: Warren M. Fabel, 961 Iris Dr., Delray Beach, Fla. 33483

[21] Appl. No.: 09/179,224

[22] Filed: Oct. 27, 1998

[51] Int. Cl.[7] ..... B65D 27/06; B42D 15/00

[52] U.S. Cl. ..... 462/25; 283/34; 283/35; 283/61; 283/62; 283/79; 283/80; 283/101; 283/105; 283/107; 283/116; 283/900; 462/17; 462/25; 462/26; 462/36; 462/45; 428/121; 428/124; 428/130

[58] Field of Search ..... 283/61, 35, 62, 283/34, 79, 80, 101, 105, 107, 116, 900; 462/17, 25, 26, 36, 45; 428/121, 124, 130

[56] References Cited

U.S. PATENT DOCUMENTS

| | | | |
|---|---|---|---|
| 3,718,277 | 2/1973 | Volkert | 428/124 |
| 5,746,450 | 5/1998 | Petkovsek | 283/116 |

*Primary Examiner*—Willmon Fridie, Jr.
*Assistant Examiner*—Mark T. Henderson
*Attorney, Agent, or Firm*—Ted W. Whitlock

[57] ABSTRACT

A form, such as a mailing form, constructed on a single laminated sheet of standard paper size, which is printable by a single pass through a standard non-impact printer, and extendible to provide additional surface area for the form exceeding standard paper size. The extendible form can be adapted for use with mailing forms such as multi-part collated unit sets. The form is useful for providing a Customs Declaration and Dispatch Note having each part printable by a single pass through a non-impact printer.

19 Claims, 9 Drawing Sheets

EXTENDIBLE FORM FOR NON-IMPACT PRINTER

BACKGROUND OF THE INVENTION

Forms which are required to be completed in duplicate, triplicate, or other multiples, are normally manufactured as unit sets, also commonly known as snap-out sets, so that information inscribed or printed on a top ply or part is transferred to underlying parts by a transfer means such as carbon paper. Alternatively, chemically mated carbonless paper, which is acted on by applying pressure to a top ply, is also a well-known method for transferring information inscribed on an outer surface of a top ply through, and onto, multiple plies or parts underlying the top ply.

With the advent of readily available non-impact printers, however, printed information applied to a top part of a unit set is not transferred to underlying parts due to the absence of pressured printing being applied to the top part during the printing process. Thus, non-impact printers are unable to be used efficiently for printing information on a unit set form wherein identical information may be transferred from a top part of the set to underlying parts.

Another disadvantage of certain forms, such as mailing forms, in their application for use with a standard non-impact printer, is the particular size requirements designated by organizations which employ or authorize such forms. For example, the Universal Postal Union (UPU) designates size requirements for forms used in international transport of mail pieces or parcels by governmental postal agencies, including the United States Postal Service (USPS). The UPU rules and regulations are followed by postal agencies in as many as 140 countries worldwide.

One such form regulated by the UPU is the Customs Declaration and Dispatch Note, currently provided in the United States as Postal Service Form 2976-A. The Customs Declaration and Dispatch Note is a four-part form, having each part collated along its left edge forming a stub. Each part is removable from the stub along a perforation line. The four parts of the form include two copies of the "Customs Declaration" form, one copy of a "Dispatch Note," and a fourth "Post Office Copy." This fourth Post Office Copy may not be used in larger mailings (three or more pieces). Instead of this fourth Post Office copy, a Manifest Listing, referred to by the USPS as a Firm Mailing Book, is typically used.

Each part of the unit set forming the Customs Declaration and Dispatch Note has a designated overall size requirement of approximately 7" wide by 5½" in height, plus an approximately ½" stub on the left. Thus, adapting such a form for use with a non-impact printer can be problematic because the total area of the four parts, in any arrangement to provide them as a single sheet for printing by a non-impact printer in a single pass, is greater than the area of a standard 8½" wide sheet. This width of a standard size sheet may not be exceeded because a feeder tray on a standard non-impact printer will not accept wider sheets. In addition, configuring three or more parts end-to-end on a single sheet would require the sheet to be at least 16½" in length (three 5½" parts), which is longer than the available standard sheet (8½"×14") compatible with most standard non-impact printers.

The size requirements for the form are not readily varied because they are dictated by the size of the UPU and USPS-approved transparent insert envelope which is affixed to the package or mailing piece for use with the Customs Declaration and Dispatch Note. The envelope approved for use by the USPS is designated as PS 2976E. Prior to the development of the subject invention, a Customs Declaration Dispatch Note printable by a single pass through a non-impact printer, was unavailable, though greatly needed.

BRIEF SUMMARY OF THE INVENTION

It is an object of the subject invention to provide a laminated form, having a total surface area greater than the area of a standard sheet of paper, constructed as a single sheet of printable material of standard paper size, and capable of being printed on by a standard non-impact printer in a single pass. The subject laminated form is further constructed such that at least one of the laminates can be extended to provide additional surface area for entry or application of additional information after printing on the non-impact printer.

It is another object of the subject invention to provide a laminated, multi-part form, wherein a designated size for the parts results in their total surface area being larger than a standard paper size, constructed and arranged as separable sections on a single laminated sheet of printable material of standard paper size. The construction of the subject form is such that at least one of the sections can be extended to meet the size requirement designated for each part. Preferably, at least one section can be constructed in a folded configuration so that, before being extended, the total surface area of all the parts is equal to or less than a standard size paper.

Arranging the parts of a multi-part form on a single sheet of printable material having the size of a standard sheet of paper can advantageously provide a form printable by a single pass through a standard non-impact printer. The folded area can be extended, e.g., unfolded, for further advantageous use after printing by the non-impact printer. For example, the extended area can provide additional surface area or space for entry or application of additional information after printing on a non-impact printer.

It is a further object of the invention to provide a laminated, multi-part Customs Declaration and Dispatch Note form, wherein the required approximately 7½" wide by 5½" in height parts of the form are constructed and arranged to fit on a single 8½" by 14" sheet of printable material, e.g., paper, so that the printable surface of each part can be printed by a non-impact printer in a single pass. At least one laminate of at least one part of the subject single-sheet Customs Declaration and Dispatch Note is extendibly configured so that concealed areas which are not printed by the non-impact printer can be exposed for further use after printing.

In one embodiment, the subject invention comprises a laminated sheet of material printable by a non-impact printer, e.g., an 8½"×14" sheet of paper, wherein the sheet has die-cuts or perforations to provide separable sections which can be separated and collated to form a multi-part Customs Declaration and Dispatch Note form. In the preferred embodiment, the form is provided as a sheet having at least three sections, each section forming a part. The first and second sections form two of the parts which can be identically pre-printed to provide the first and second copies of the Customs Declaration portion of the form. A third section forms a third part which is the Dispatch Note portion of the form and is pre-printed to include designated areas for such Dispatch Note portion. The fourth part normally provided on PS Form 2976-A is omitted in the preferred embodiment because the information normally included on the fourth part can instead be provided in a manifest listing, which is also referred to as a Firm Mailing Book.

The form of the subject invention can preferably be pre-printed to imprint divided and designated areas serving as information blocks which provide discrete areas for entering barcode information, address information, addressee information, package contents information, insurance information, sender's instruction information, signature area, and the like. In the currently available PS Form 2976A, the Dispatch Note includes an area for applying appropriate customs stamps. This stamp area is preferably positioned to correspond to the area of the Customs Declaration portion of the form used for listing package contents information. Because this customs stamp area does not require information to be inscribed or printed by a printer, the area can be omitted from the printable face of the form. One way to omit a non-printed or non-inscribed area from a printable face is to foldably configure the area, e.g., in a Z-fold configuration, so that the area is effectively concealed during the non-impact printing process. Advantageously, this folded section can be made extendible for exposing the concealed areas after printing by the non-impact printer.

The laminated form according to the subject invention comprises a plurality of superimposed substrates of printable material, e.g., paper, which can have adhesive material and adhesive-release material patternly disposed on their opposing, inner surfaces. These patterned areas of adhesive can provide permanently adhered areas to form the laminate, and the patterned adhesive-release material can provide areas that are releasably adhered to the opposing sheet so that adhesive can be exposed for later use, for example, to join together separate parts collated to form a multi-part unit set.

The preferred embodiment can include a taggant for specifying insured mail. An article number, e.g., insured mail number, or an invalidation designation, e.g., the word "VOID," can be conveniently printed by the non-impact printer during the process of printing mailing information on the form. This taggant can have an adhesive backing formed by the patternly disposed adhesive on the inner face of one of the laminates forming the laminated assembly. The adhesive backed taggant is releasable from the opposing layer by having an area of adhesive-release material patternly disposed on the opposing face of that opposing layer.

In operation, the preferred embodiment of the extendible laminated form of the subject invention is processed through a non-impact printer so that address information package content information, and the like, is printed on the front face of each separable section of the form. The extendible portion is then extended to provide three identically sized parts which can be separated and collated to be superimposed over one another, forming a multi-ply form, e.g., a Customs Declaration and Dispatch Note. The subject form can be collated by adhering each of the parts along a marginal stub or can be physically attached together by affixing a staple or other like attachment means through each of the parts.

BRIEF DESCRIPTION OF THE DRAWINGS

FIG. 3A shows a left side of a generally two-part form having a strip forming a third part, in order to provide an extension section, disposed between and joined to the two outer parts.

FIG. 3B shows a left side of a generally three-part form wherein a section of the middle third part provides the extension portion.

FIG. 3C shows a left side of a generally two-part form wherein the bottom layer is plow folded to form a Z-fold formation to provide the extension portion.

DETAILED DESCRIPTION OF THE PREFERRED EMBODIMENTS

Figure 1:
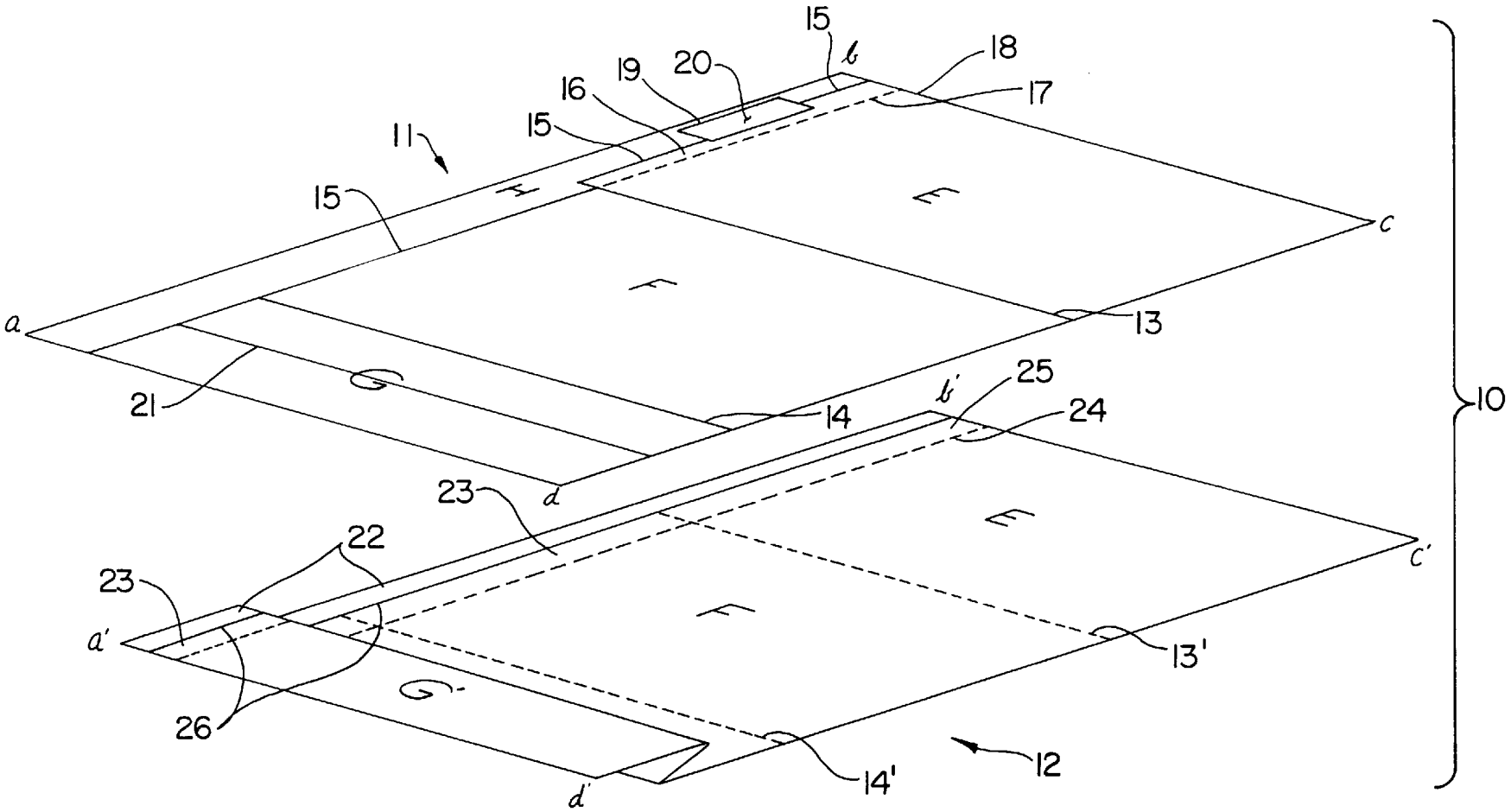
FIG. 1 shows an exploded, front right perspective view of an embodiment of the form according to the subject invention, illustrating die-cuts and perforations forming particular sections of the form, as well as the folded configuration of the bottom layer forming the extendible portion.

The subject invention concerns a form, e.g., a mailing form, configured on a laminated sheet of standard paper size for compatibility with a standard non-impact printer. Advantageously, the form is extendible to provide additional surface area for inscribing or applying additional information after the form is printed by the non-impact printer. Preferably, the extendible form can be constructed in a folded configuration whereby the folded area can be unfolded and extended after printing on the non-impact printer to provide said additional surface area or space on the form.

It would be understood that the extendible configuration or other aspects of the invention can be adapted for use with forms or assemblies other than mailing forms. In particular, any form requiring surface area greater than a standard paper size can be configured, e.g., folded, to fit on a single sheet or substrate of standard paper size. This standard size sheet can then be extended to provide the required surface area. Preferably, the subject invention can be applied for use with a multi-part, laminated form, having the parts, the total surface area of which would normally exceed a standard paper size, arranged in an extendible configuration so that all the parts fit on a single standard-sized sheet of printable material. The subject invention includes an extendible portion of the form which can be extended to meet a size requirement after the form is printed. The extendible portion provides an area for inscribing or applying additional information which may be required to be entered onto the form by means other than a non-impact printer. The extendible portion can be in the configuration of a fold, e.g., a Z-fold, which is easily constructed in a continuous web by means of a plow, as is well known in the printer's art.

The laminated form is preferably constructed as two layers of sheets which can be superimposed to form a single laminated sheet by adhering together opposing faces of the sheets in particular areas. The subject invention is described, for exemplary purposes only, as being constructed of paper sheets. However, it would be understood that other materials in common use for printed forms can be used so long as those materials are compatible for printing on a non-impact printer. would be understood by persons of ordinary skill in the art, additional layers can be used as necessary, for example, to provide additional thickness for the form, or other instances when three or more layers are used for a laminated form. In the preferred two-layer configuration, at least one of the layers is made extendible, e.g., by a plow fold which can be formed in the extendible layer prior to laminating the two layers together.

Adhesive material, which is well-known and commonly used in the art, can be disposed in a particular pattern between opposing faces of the laminated sheets so that the laminates are substantially permanently adhesively joined together in those patterned adhesive areas. Adhesive-release material, e.g., silicone, can be patternly disposed between a face of one of the sheets and the adhesive disposed on the opposing face of the opposing sheet so that the form is releasably adhered in those patternly disposed adhesive-release areas.

The patternly disposed adhesive and adhesive-release materials can allow a portion of an adhesive-backed laminate to be exposed for adhering to a different surface at a later time. For example, a peel-off label having adhesive disposed on one face thereof can be formed by patternly disposing adhesive-release material on an opposing face of the opposing sheet in an area corresponding to the label. As another example, a peel-off strip which protects adhesive for later use can be formed by patternly disposing adhesive-release material on the inner face of the strip such that the strip can be releasably adhered to an adhesive-disposed opposing sheet, wherein adhesive is exposed for use after removal of the protective strip. The peel-off label and adhesive protective strip can be formed by die-cuts through a single layer of the laminated form so that the die-cut layer can be separated from the corresponding area of the opposing layer.

Die-cuts or perforations, or alternating die-cuts and perforations, can also be formed in one or more layers of the laminated sheet to provide separable sections of the form, including separable sections forming separate parts of a multi-part form. Alternatively, die-cuts or perforations can be made in one or more of the sheets to form discardable areas or sections which can be removed to make efficient use of the sheet. In a preferred embodiment, an alternating die-cut and perforation can be made in one layer of the form for easy release, separation, and extension of one section thereof.

The subject invention can be understood by reference to the figures showing a preferred embodiment as applied to a Customs Declaration and Dispatch Note form. Referring now to the figures, FIG. 1 shows, in an exploded perspective view, die-cuts and perforations formed in a two-layer laminated Customs Declaration and Dispatch Note form 10 according to the subject invention. Top layer 11 and bottom layer 12 are superimposed such that corners a, b, c, and d of the top layer respectively match to corners a', b', c', and d' of the bottom layer when laminated together.

Transverse die cuts 13 and 14, which are made through top layer 11, and corresponding transverse perforations 13' and 14', which are made into bottom layer 12, divide the sheets into separable sections E, F, and G. Because the top and bottom layers are joined, laminated sections E, F, and G can be separated and superimposed over one another to form first, second, and third parts of the multi-part form. Die-cuts 13, 14 and perforations 13', 14' are positioned on the sheets to form sections E and F of identical dimension, namely, in compliance with the size requirements designated by the Universal Postal Union (UPU) or United States Postal Service (USPS) for a part of the Customs Declaration and Dispatch Note multi-part form. Thus, sections E and F are made to be approximately 5½" in height. For the embodiment used for a UPU-compliant Customs Declaration and Dispatch Note, the form is preferably constructed on a 8½"×14" sheet, which leaves section G approximately 3" in height.

In order to provide a third part, shown in the drawings as section G, which also meets the size requirement of approximately 5½" in height, the top layer 11 of that section is divided by a transverse tear line 21 so that section G can be extended to meet the size requirement. The tear line 21 can be formed by a loose perforation, i.e., substantially a die-cut having one or more "paper ties" known in the art to refer to an incomplete cut in a particular (usually small) area, to maintain the integrity of the top layer of the form. In this embodiment, the extension for section G is provided by the extendibly configured portion of bottom layer 12.

Referring to top layer 11 in FIG. 1, die-cut 15 is formed substantially perpendicular to die-cuts 13 and 14, and provides a releasable strip H, approximately 1½" wide in the preferred embodiment, which borders part sections F and G. Die-cut 15 is configured to be offset from part section E to provide a stub 16 which borders part or section E. In addition, die-cut 15 can include at least one paper tie in order to maintain the integrity of the form when printed on a non-impact printer. Releasable strip H is completely removable from form 10 and carries with it removable strip 22 on bottom layer 12, which together form a partially two-layered laminate discardable strip. Releasable strip H is wider than removable strip 22, and can also serve as an adhesive protective strip for adhesive disposed on the inner face of bottom layer 12 at stub sections 23, formed along an edge of part sections F and G. By removing strip H, adhesive disposed on the inner face of section 23 on bottom layer 12 is exposed for collating part sections F and G under part section E.

Stub 16 and section E are made separable from one another by perforation 17 which extends from the intersection of perforation 13 and die-cut 15, along an edge of part section E to edge 18 of the form 10. In the embodiment shown, a substantially rectangular die-cut 19 is made in releasable strip H to form a removable label or taggant 20. The taggant 20 can be used to form an insured mail label, which is commonly used in international mailing. As can be seen from the drawing, die-cut 15 is coextensive with a portion of an edge of taggant 20 formed by the substantially rectangular die-cut 19. It would also be understood that additional peel-off labels could be formed in releasable strip H, and that die-cut 15 would be configured to accommodate any additional labels in a manner substantially similar to the configuration along the edge of section E.

Perforations 13' and 14' transversely formed in bottom layer 12 divide the bottom layer into part sections E, F, and G. However, bottom layer 12 is constructed on an 8½' wide by 16½" long sheet so that the bottom layer parts E, F and G can each be 5½" in height. Bottom layer 12 therefore must be configured so that it is shortened for corresponding to the same length and width as the top layer 11 which is standard paper size. In a preferred embodiment, the width of the top and bottom layers are equivalent; therefore, the length of the longer bottom layer 12 can be configured to correspond to the length of top layer 11. Preferably, part section G in bottom layer 12 is folded to achieve this shortened configuration and, more preferably, comprises a Z-fold configuration. It is well known in the art that a Z-fold can be formed in a continuous web by a plow folder which forms appropriate creases in the web to form the folded configuration.

In addition, bottom layer 12 can include a perforation 24 which forms stub section 25 along one side edge of part section E, and stub sections 23 along the same side edge of bottom layer part sections F and G. Die-cut 26 is formed in bottom layer 12 parallel to perforation 24, forming the outer edge of stub sections 23 and 25. Removable strip 22 is also formed by die-cut 26, being defined by die-cut 26 and the outer left side edge of bottom layer 12. As described, this removable strip 22 is permanently laminated to releasable strip H formed in the top layer 11, and is discardable after printing and processing of the form.

Figures 2A, 2B, 2C:
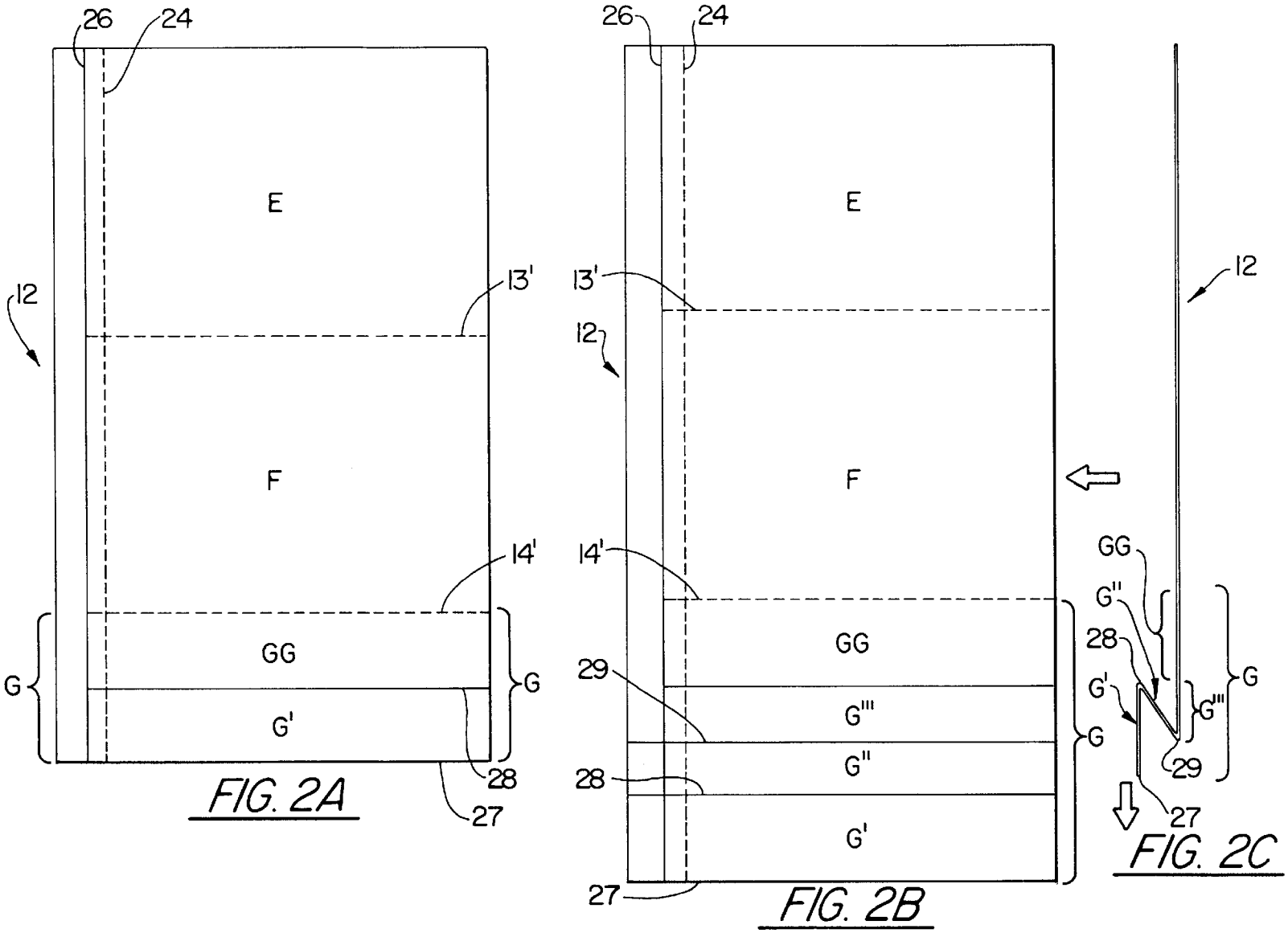
FIG. 2A shows an elevated front face of the bottom layer of an embodiment of the form according to the subject invention in folded configuration.
FIG. 2B shows an elevated front face of the bottom layer of an embodiment of the form according to the subject invention in extended configuration.
FIG. 2C shows a right side elevation of the folded configuration of the embodiment shown in FIGS. 2A and 2B.

The extendible portion of bottom layer 12 is illustrated in more detail in FIGS. 2A–2C, which show a Customs Declaration and Dispatch Note embodiment provided in Z-fold configuration.

FIG. 2A shows an elevated view of a front face of bottom layer 12 in its shortened, e.g., folded, configuration. Multipart section G, extending from perforation 14' to bottom edge 27, comprises panels G and GG which form the front (inner) face of bottom layer 12 in the shortened (folded) configuration. Panel G' is defined by bottom edge 27 and fold line 28; panel GG is defined by fold line 28 and perforation 14'.

In the extended configuration, as shown in FIG. 2B, part G is shown to further comprise panels G' and G"', which are concealed behind panel G' in the folded configuration. Panel G" is defined between fold lines 28 and 29. Panel G"' is defined by the shaded area extending upward from fold line 29. Together, panels G" and G"' form the extension section of the form which provides the additional surface area or space for entry application of additional information. In an embodiment which has a bottom layer constructed on a 16½" long sheet, extendible from 14" in the folded configuration, the fold lines 28 and 29 are made so that panels G" and G"' are approximately equal in size, typically 1¼" each, to provide 2½" of extension section.

FIG. 2C shows bottom layer 12 (viewed from the side indicated by dark arrow in FIG. 2B) illustrating the formation of panels G', G", G"', and GG in a folded configuration. The form is extendible in the direction of the white arrow.

Figure 3A:
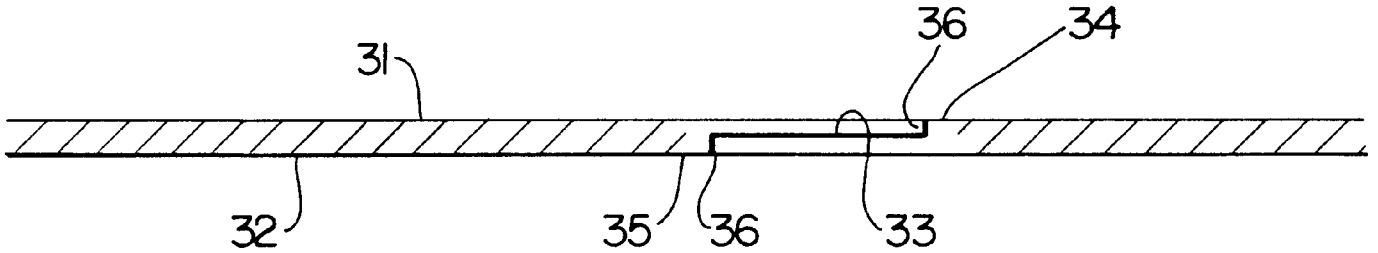
FIGS. 3A–3C show variations of the folded configuration.
Figure 3B:
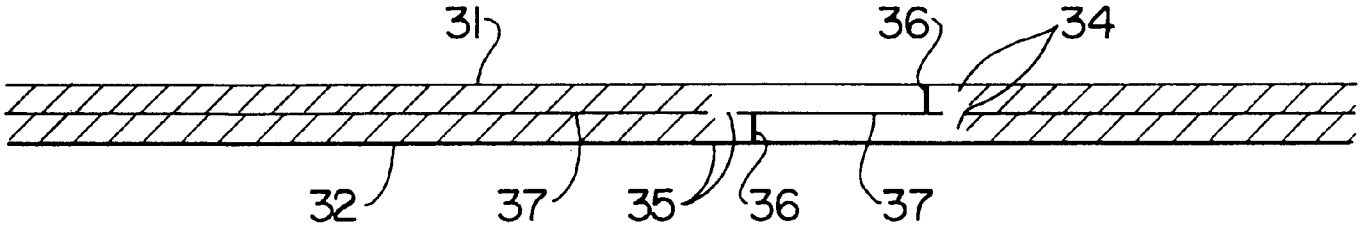

It would be understood that the extension portion of one of the layers in the subject extendible form can be constructed by means other than folding. For example, separate sections of form material, rather than a continuous folded sheet, can be adhered together to form a fold. This variation is shown in FIG. 3A, wherein a first top layer 31 is adjoined to a second bottom layer 32, and a third, middle layer 33 forming the extension section. This middle layer 33 has a width approximately equal to the width of a standard sheet, but has a height which is just longer than the dimension of the extension portion to provide an extension area and an overlap with the top and bottom layers. To join middle layer 33 with top and bottom layers 31 and 32, a plurality of spots or a strip of adhesive can be applied between the layers. Preferably, a strip of adhesive 36 is transversely applied between opposing faces of top layer 31 and middle layer 33 just inside perforation 34 formed in the top layer, and between opposing faces of the bottom layer 32 and middle layer 33 just inside perforation 35 formed in the bottom layer.

Top layer 31 comprises a full standard-sized sheet having perforation 34 formed at one end of middle layer 33. Bottom layer 32 comprises a full, standard size sheet having perforation 35 formed at the opposite end of middle layer 33. The top and bottom layers 31 and 32 are laminated by means of adhesive (shown as cross-hatching) disposed on their inner opposing faces from outside the extension portion to each end of the sheet.

Another variation includes a form comprising a trilaminate configuration. This variant is substantially similar to that shown and described for FIG. 3A, except that middle layer 37 comprises a full, standard size sheet disposed between top layer 31 and bottom layer 32. Adhesive (shown as cross-hatching) can be disposed on substantially the entire inner surfaces of top and bottom layers 31 and 32 and on both surfaces of middle layer 37, except in the area of the extension portion. In this configuration, middle layer 37 includes a perforation or die-cut 34, 35 at each end of middle layer extension portion 37, correspondent with or slightly offset from perforations 34 and 35 formed in the respective top and bottom layers 31 and 32.

Figure 3C:
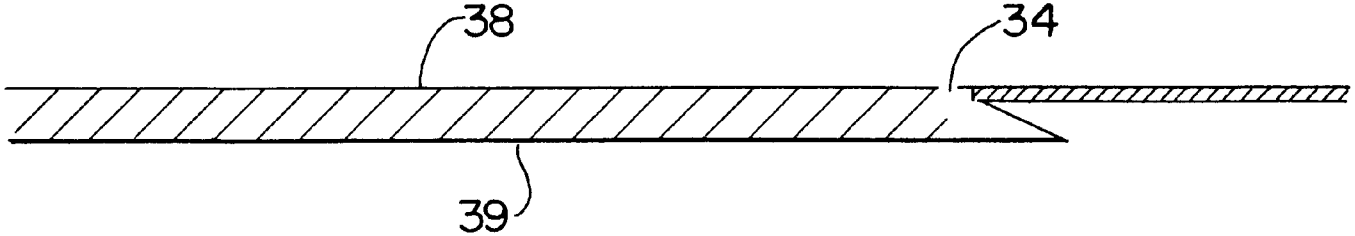

FIG. 3C illustrates the configuration wherein the two-layer laminated form comprises top layer 38 and bottom layer 39 wherein the bottom layer 37 is in a Z-fold configuration. The top and bottom layers are joined by disposing adhesive (shown as cross-hatching) substantially entirely on the inner opposing surfaces, except in the extension portion formed by the Z-fold. The Z-fold portion of the bottom layer does not oppose the top layer and can be substantially adhesive-free. It would be readily understood that small discrete areas or "spots" of adhesive material and/or adhesive-release material can be disposed in certain areas between the extension portion and an opposing face of the top or bottom layer so that the form retains a flat configuration during the printing process, but wherein a releasable bond is formed so the form can be easily extended.

The subject invention is described herein as having the fold or extension portion formed in the bottom layer of the form. Persons of ordinary skill in the art would recognize that the fold or extension portion can also be constructed in the top layer. However, it is preferred that the fold or extension portion be formed in the bottom layer so that the surface being printed by the non-impact printer is free of such folds or extension portions.

Figure 4B:
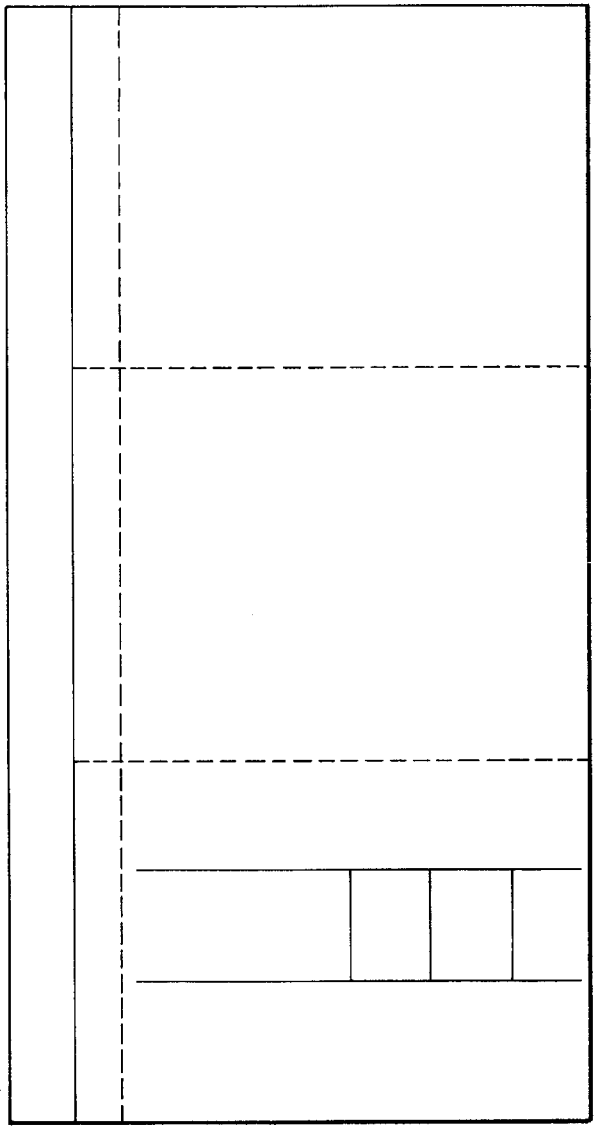
FIG. 4B shows an elevated front, inner face of the bottom layer of the embodiment of FIG. 4A, as pre-printed in the extension portion to provide the additional space for the form.
Figure 4A:
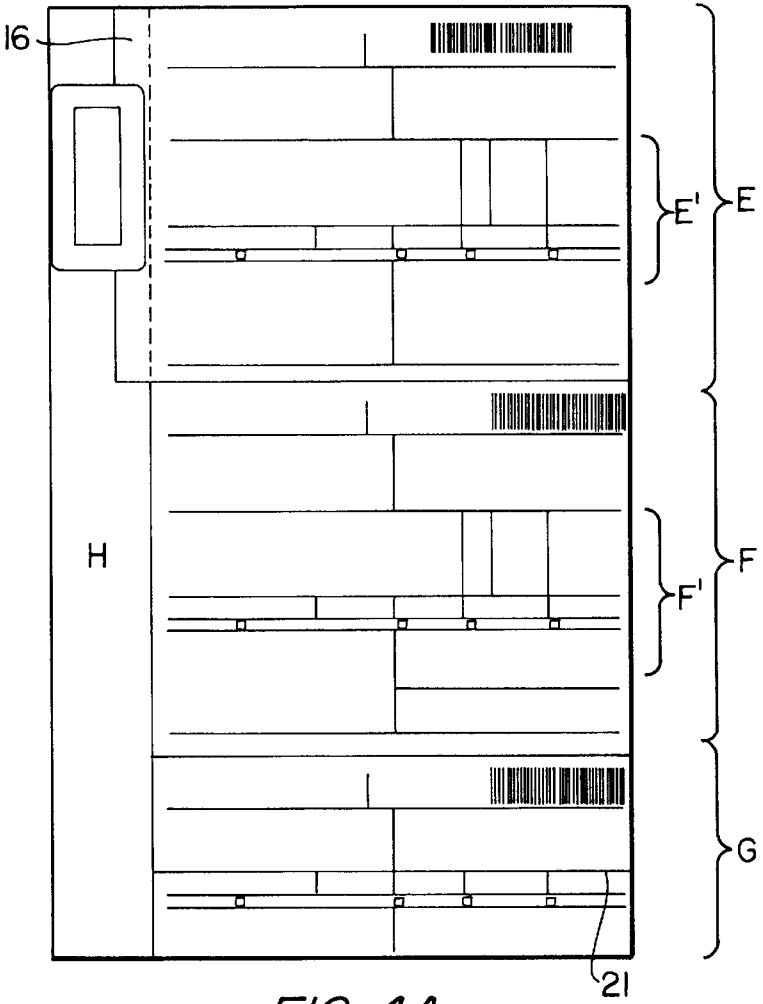
FIG. 4A shows an elevated front face of the top layer of an embodiment of the form according to the subject invention, as pre-printed to make a multi-part Customs Declaration and Dispatch Note (PS 2976A).

FIG. 4A shows an elevated view of a front face of the pre-printed top layer of a Customs Declaration and Dispatch Note (PS Form 2976A) embodiment of the subject invention. The form is shown comprising first and second part sections E and F of approximately equal width, preferably about 7½", including stub 16, and approximately of equal height, preferably 5½'. Third part G is comparatively shorter in height relative to parts E and F because the contents listing area, shown respectively as sections E' and F', is omitted. This area can be omitted from part G because it does not need to be printed on by the non-impact printer. In the embodiment using an 8½"×14" sheet, part section G is approximately 3" in height, thus omitting an approximately 2½" section. This section, which can be omitted from the top layer of part section G, is however, required for entry of additional mailing information, e.g., application of customs stamps. Therefore, part G can include a separation line 21 whereby G can be separated in two and extended to provide the omitted section after printing on a non-impact printer.

Preferably, the omitted section can be provided by a foldably configured section on which part G of bottom layer 12 is foldably concealed during the non-impact printing process. Most preferably, this omitted section can be provided by a foldably configured extension portion included in the underlying bottom layer as described herein. The bottom layer 12 can be pre-printed to provide the designated additional space, e.g., areas for application of customs stamps (see FIG. 4B).

Figure 5:
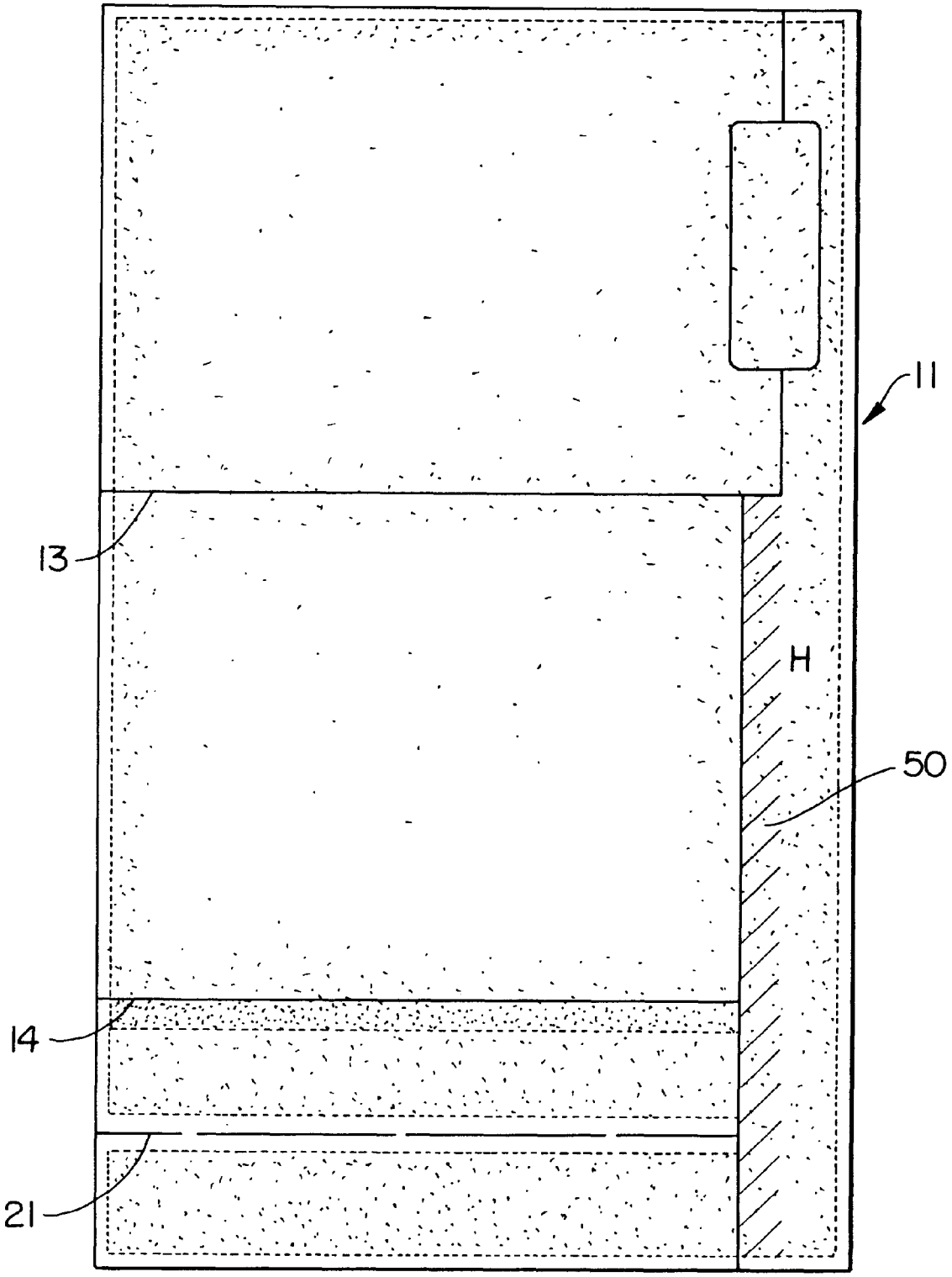
FIG. 5 shows an elevated back face of a top layer of an embodiment of the form according to the subject invention, illustrating patternly disposed adhesive and adhesive-release material.

FIG. 5 shows an elevated view of the back face of the top layer 11 of the embodiment shown in FIGS. 1–4, illustrating patternly disposed adhesive release material 50 on releasable strip H. This adhesive-release material 50 is removable from the corresponding adhesive-disposed area on the opposing face of the bottom layer (not shown). When releasable strip H is removed, adhesive-disposed stub areas on the bottom layer are exposed for collating the parts into a multi-part form. Adhesive material is disposed on the substantially entire back face of top layer 11 except an approximately 1/16"–⅛" adhesive-free margin around the perimeter of the sheet to allow for possible oozing of adhesive when exposed to the heat of a laser printer, and an adhesive-free band coincident with and centered around die-cut 21 to minimize areas of exposed glue or stringing when the form is extended.

Figure 6B:
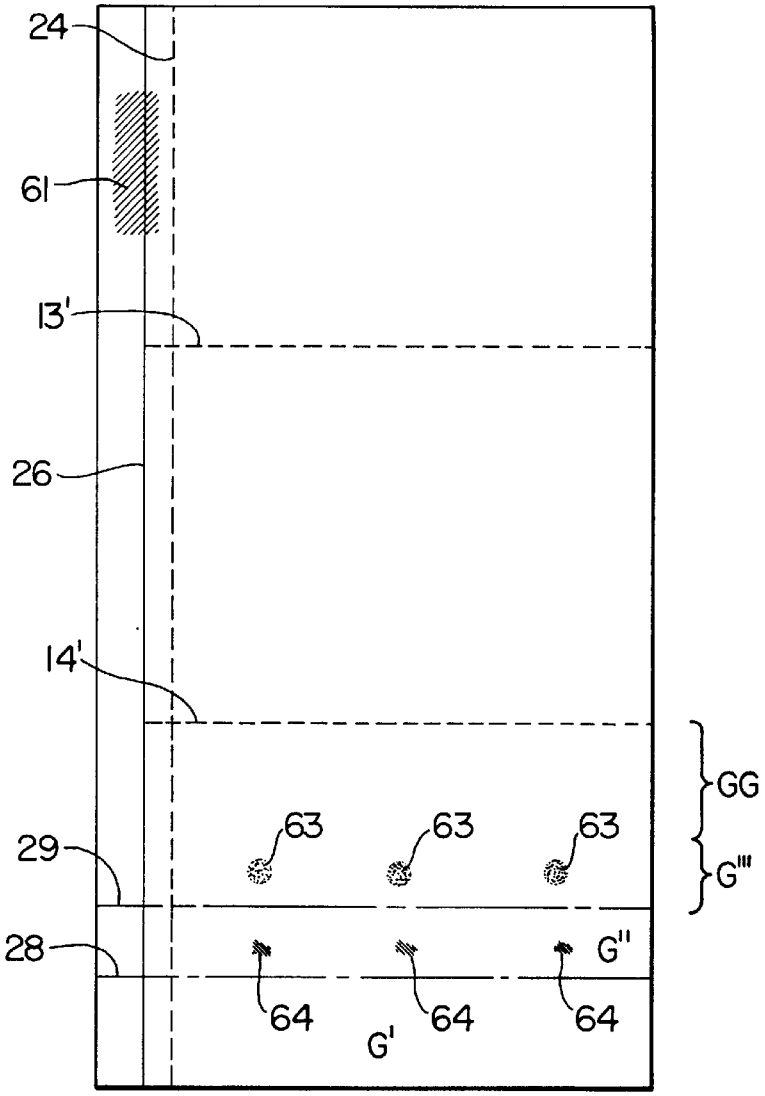
FIG. 6B shows an elevated front or inner face of the bottom layer of a form according to the subject invention, in extended configuration, illustrating die-cut and perforation lines formed therein, and adhesive-release material patternly disposed thereon.
Figure 6A:
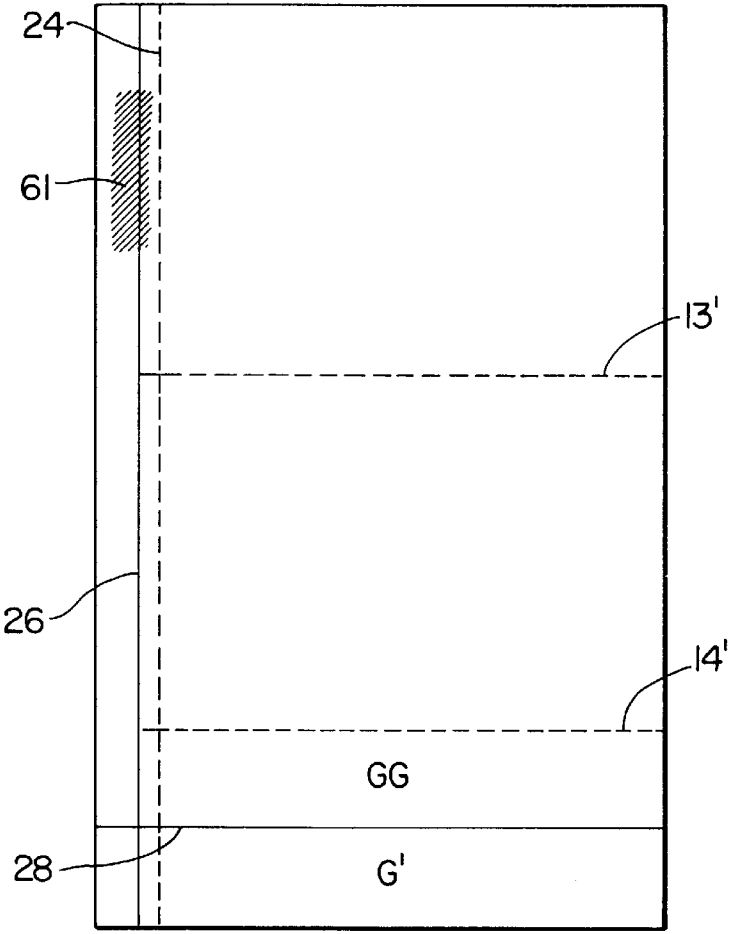
FIG. 6A shows an elevated front or inner face of the back layer of a form according to the subject invention, in folded configuration, illustrating die-cut and perforation lines formed therein, as well as adhesive-release material patternly disposed thereon.

FIG. 6A shows a front or inner face of a bottom layer 12 of the embodiment of the subject invention shown in FIGS. 1–5 in a folded configuration. Adhesive-release material can be disposed in the taggant release area 61 corresponding to the peel-off label or taggant provided by die-cuts in the top layer.

FIG. 6B shows the extended configuration for bottom layer 12, revealing the front faces of panels G" and G"'. Patternly spotted adhesive 63 can be disposed on panel G"' to match corresponding patternly spotted adhesive-release material 64 disposed on panel G". Specifically, these patterned areas of adhesive and adhesive-release material are useful for releasably tacking opposing faces of panels G" and G"' in folded configuration. In addition, adhesive spots 63 can serve to hold together corresponding areas of the top and bottom layers after the form is extended.

Figure 7B:
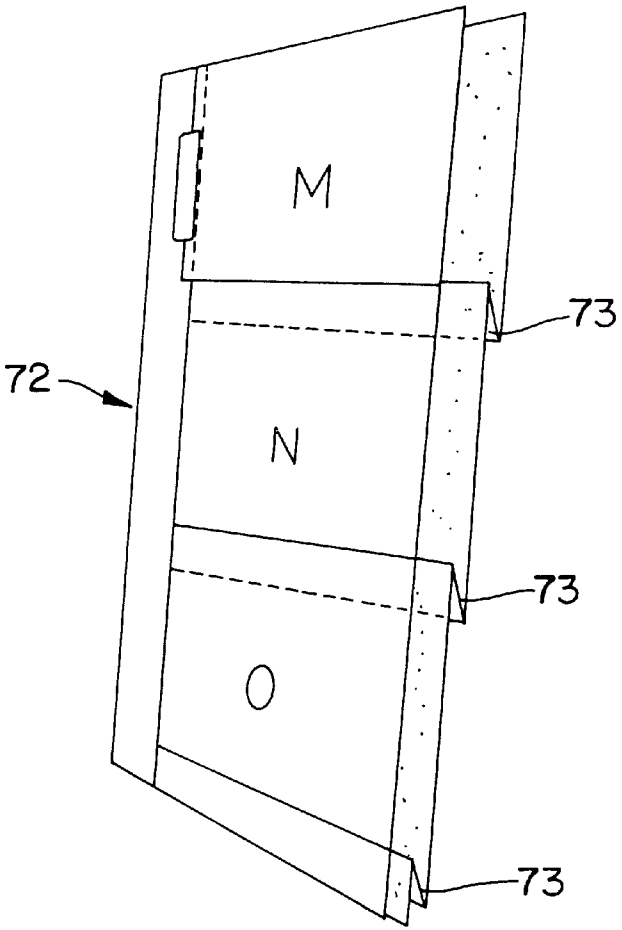
FIG. 7B shows a variation of the subject extendible form having three foldably configured extendible sections formed therein.
Figure 7A:
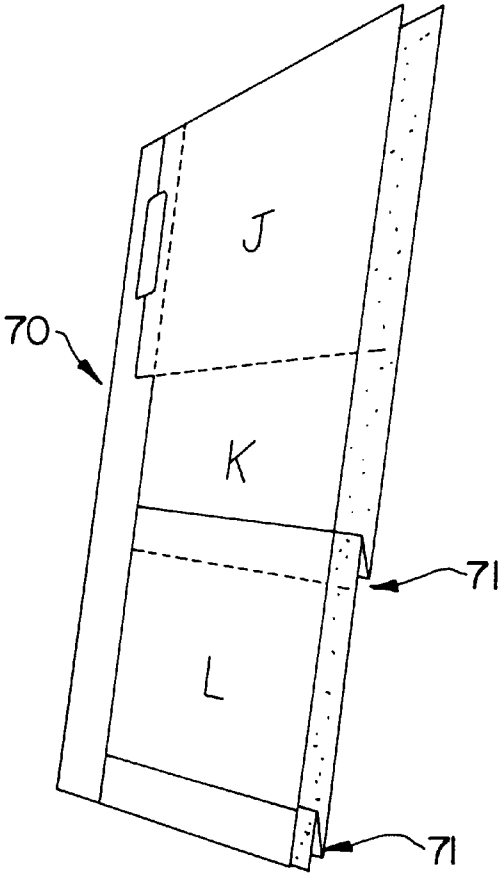
FIG. 7A shows a variation of the subject extendible form having two foldably configured extendible sections formed therein.

Further alterative embodiments for the subject extendible form are shown in FIGS. 7 and 8. FIGS. 7A and 7B show perspective views of a laminated form having a plurality of Z-folds provided in the bottom layer. Specifically, FIG. 7A shows an extendible laminated form 70 having a Z-fold 71 in two part sections; FIG. 7B shows an extendible laminated form 72 having Z-folds 73 in three part sections. It would be readily understood that a plurality of fold configurations could also be formed in any single part section.

Figure 8B:
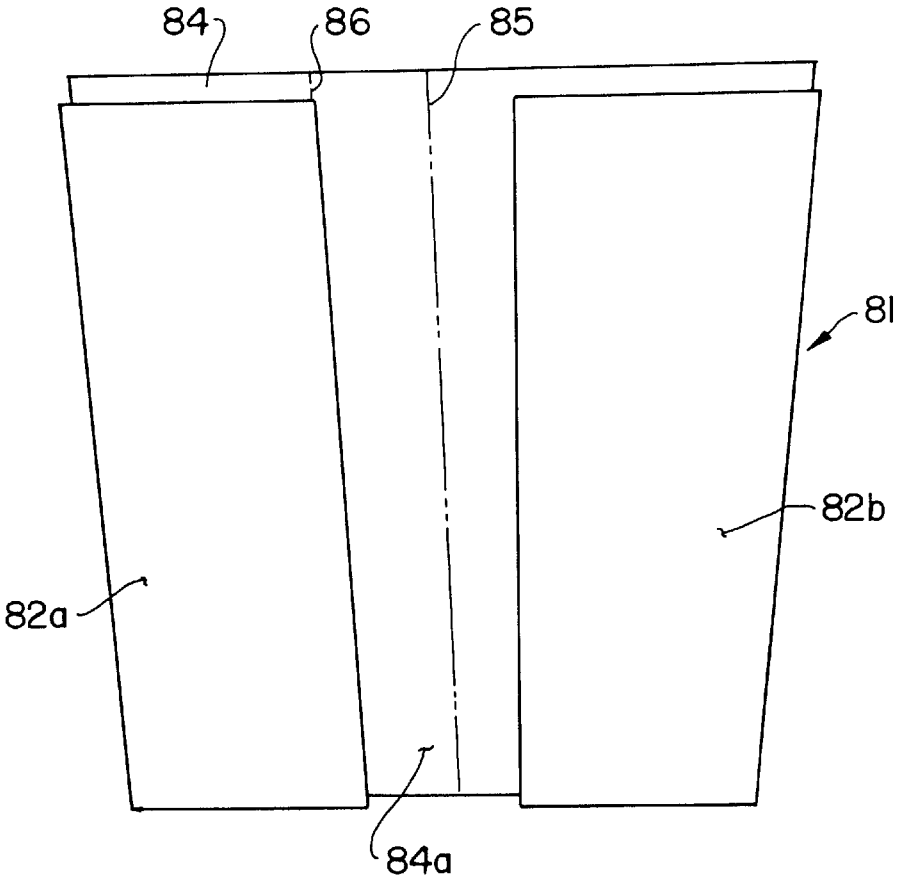
FIG. 8B shows an extendible form according to the subject invention, in extended configuration, wherein the form is extended from a folded configuration along a vertical axis.
Figure 8A:
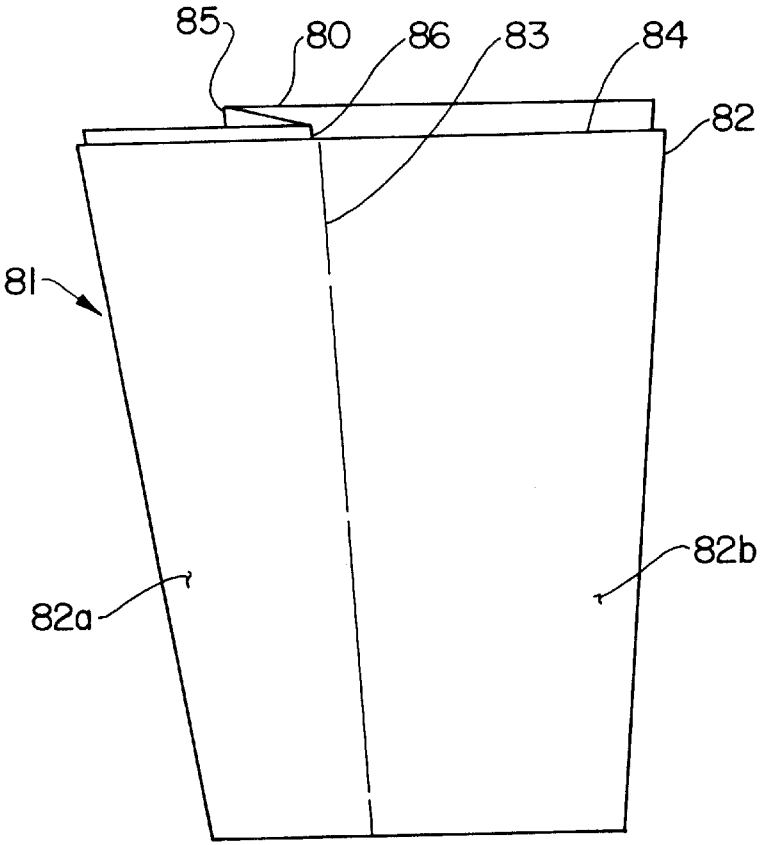
FIG. 8A shows an extendible form according to the subject invention, in folded configuration, wherein the form is foldably configured along a vertical axis.

FIGS. 8A and 8B illustrate an embodiment of the subject extendible form having a plow (Z-)fold 80 formed along a vertical axis, i.e., parallel to the length of laminated sheet 81. FIG. 8A shows the vertical-fold configuration wherein top layer 82 has a separation line 83 formed as a die-cut or perforation along the vertical axis so that panels 82*a* and 82*b* can be separated along that axis to extend the width of form 81. The bottom layer 84 is shown foldably configured, particularly showing folding along fold lines 85 and 86. FIG. 8B shows vertical fold embodiment in the extended configuration. Extension panel 84, having fold line 85 formed therein, can provide additional surface area or space for use after non-impact printing.

To manufacture an extendible form according to the subject invention, it is preferred to use an continuous web of printable material, preferably a high quality paper stock compatible with non-impact printing for the top layer, and a separate continuous web for the bottom layer. The top layer and bottom layers are pre-printed to provide discrete information entry areas on the front faces of the layers. The bottom layer is printed only in the area which is concealed in folded configuration and which is exposed in extended configuration. Die-cuts and perforations are formed in the appropriate positions in each web, as well as the formation of a Z-fold in the bottom layer by use of a plow folder.

Adhesive material and adhesive-release material can be disposed on the opposing faces of each layer and the layers cut to length. The top layer is preferably cut to a standard paper size, e.g., 8½"×11" or 8½"×14". The bottom layer is cut so that it is the same as the top layer when the bottom layer is in a folded configuration. Thus, for an 8½"×14" standard size, as in a preferred embodiment of the subject extendible form, a bottom layer having a Z-fold wherein two 1¼" sections overlap to form the extendible folded portion, the bottom layer is cut to 16½". The top and bottom layers can then be adjoined and adhered together in those areas having adhesive disposed therebetween, forming the extendible laminated sheet useful as an extendible form, e.g., an extendible Customs Declaration and Dispatch Note form blank.

Figure 9:
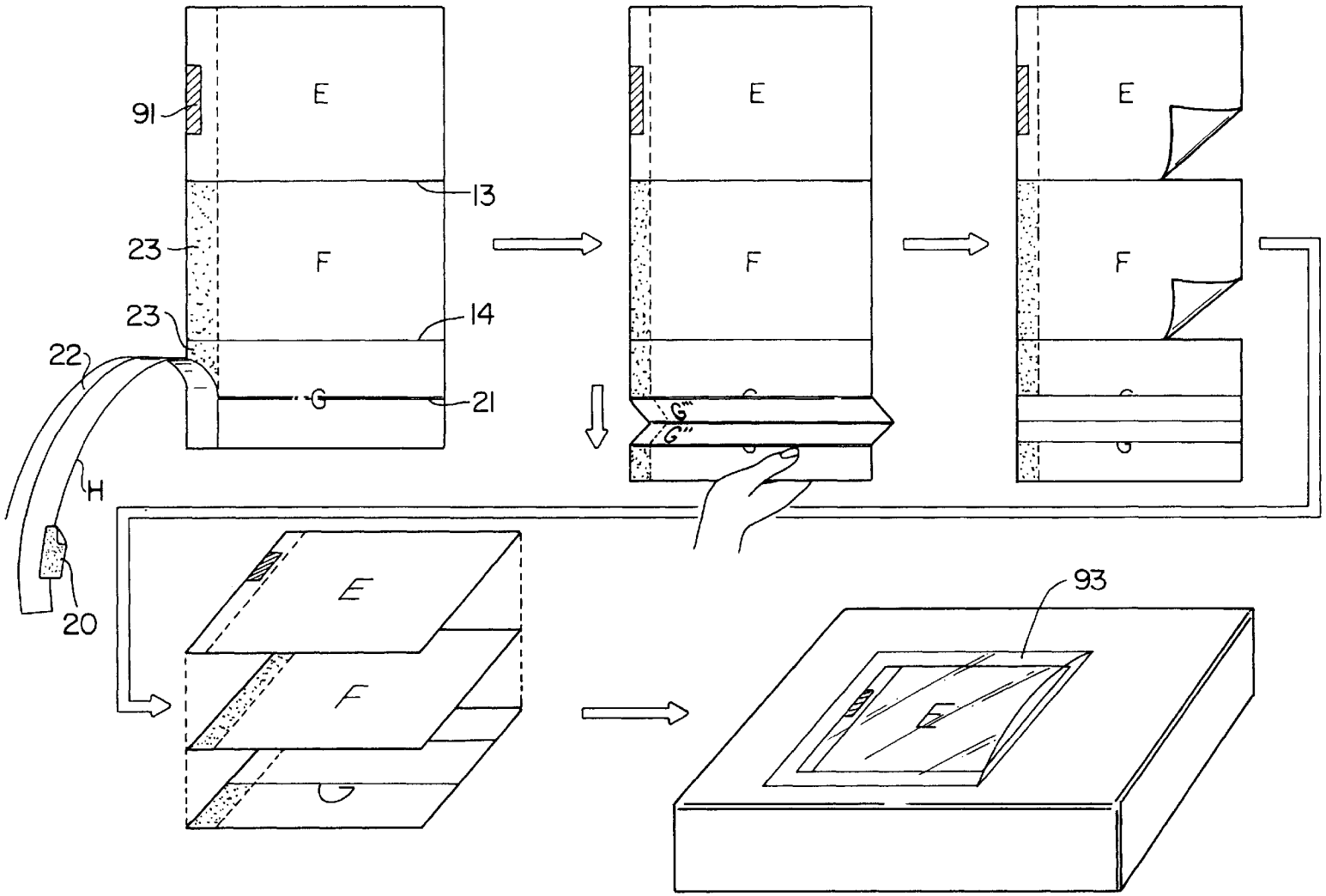
FIG. 9 illustrates the step-wise procedure for forming, and applying to a mail piece, a multi-part unit set from an extendible form configured on a substrate of standard paper size, according to one embodiment of the subject invention.

In use, the subject form blank can be printed with any desired or necessary information, e.g., mailing information, by a single pass through a non-impact printer. The procedure for separating and stacking the separate parts into a multi-part unit set, and applying the unit set to a mail piece or parcel is illustrated in step-wise fashion in FIG. 9. The sequential steps are shown following the solid arrows. In the multi-part Customs Declaration and Dispatch Note embodiment as described herein, after being printed by a single pass through a non-impact printer, the removable margin strip (described herein and shown in certain of the figures as releasable strip "H") is first removed from the form assembly. This removes releasable strip H and, from the bottom layer, a discardable section, shown herein as section 22. Removable strip H and discardable section 22 are joined and therefore form a dual laminate section, which can be discarded. Removing releasable strip H further removes taggant 20, leaving an exposed area 91 on stub 16 having adhesive-release material (cross-hatching) disposed on the exposed face. Adhesive (shading) disposed on the front, inner face of stub sections 23 bordering on edge of part sections F and G of the bottom layer is also exposed for collating the parts. The extendible portion can then be extended along the direction of the white arrow to provide the additional surface area or space 92 as desired.

Parts E, F, and G can then be separated along die-cut or perforation tear lines 13/13' and 14/14' and then superimposably collated to form the multi-part form. The exposed adhesive on stub sections 23 bordering sections F and G provide a means for affixing the collated parts into a unit set. In the preferred embodiment, section E is positioned as the top part; section F is positioned as the second or middle part; and section G is positioned as the bottom part. The multi-part unit set can then be inserted into a specialized substantially transparent envelope 93 affixed to the mailpiece. each of the parts have been printed with any necessary mailing information prior to collation and therefore do not require hand entry of any information on multiple parts. The extension portion of the form provides additional surface area or space for any subsequent entries, as needed. These subsequent entries, e.g., application of a customs stamp, are required on a single part only.

It should be understood that the examples and embodiments described herein are for illustrative purposes only and that various modifications or changes in light thereof will be suggested to persons skilled in the art and are to be included within the spirit and purview of this application and the scope of the appended claims.

I claim:

1. A laminated form printable by a single pass through a non-impact printer, said form comprising a first layer of standard paper size and a second layer configured to correspond to the size of the first layer, wherein said second layer is extendible to provide a form having a surface area greater than standard paper size, wherein said form further comprises a plurality of separable parts being collatible to form a multi-part unit set.

2. The form of claim 1, wherein said form is a mailing form.

3. The form of claim 1, wherein said form is a Customs Declaration and Dispatch Note.

4. The form of claim 1, wherein said form further comprises a peel-off label.

5. The form of claim 1, wherein said first layer includes a tear line for separating and extending said first layer in cooperation with the extendible second layer.

6. The form of claim 3, wherein said form comprises first, second, and third parts arranged on a single laminated substrate, said first and second parts being identical in size and said third part being extendible to be identical in size with said first and second parts.

7. The form of claim 6, wherein said first and second parts are about 7½" wide by about 5½" in height, and said third part is about 7½" wide by about 3" in height, extendible to about 5½" in height.

8. The form of claim 7, wherein said width of each part includes an approximately ½" stub.

9. The form of claim 8, wherein said form includes a removable strip which exposes adhesive on the stub of the second and third parts for collating with the first part to form a unit set.

10. The form of claim 1, wherein said form includes a plurality of peel-off labels.

11. The form of claim 1, wherein said form includes a plurality of extendible sections.

12. The form of claim 1, wherein said extendible portion is constructed as a Z-configuration having an area concealed during printing on the non-impact printer.

13. The form of claim 12, wherein said Z-configuration is formed as a Z-fold.

14. The form of claim 12, wherein said concealed area includes patternly disposed adhesive and adhesive-release materials for releasably maintaining the Z-configuration during printing on the non-impact printer.

15. The form of claim 1, wherein said form has adhesive and adhesive-release material patternly disposed on opposing surfaces of each layer of the laminated form.

16. The form of claim 1, wherein said extendible layer provides additional surface area or space for inscribing or applying additional information on the form.

17. The form of claim 16, wherein said additional information is a customs stamp.

18. The form of claim 1, wherein said second layer is extendible along a horizontal axis.

19. The form of claim 1, wherein said second layer is extendible along a vertical axis.

* * * * *